US005904257A

United States Patent [19]

Marmet et al.

[11] Patent Number: 5,904,257

[45] Date of Patent: May 18, 1999

[54] ILLUMINATED BOTTLE DISPLAY RACK

[76] Inventors: Richard A. Marmet, 215 E. 17th St., New York, N.Y. 10003; David S. Rockwell, 181 Hudson St., Apt. PH-8A, New York, N.Y. 10013; Samuel Houston Trimble, 148 Spring St.; Joshua Wesson, 43 W. 88th St., both of New York, N.Y. 10012

[21] Appl. No.: 08/972,221

[22] Filed: Nov. 17, 1997

[51] Int. Cl.[6] ..... A47F 7/00

[52] U.S. Cl. ..... 211/75

[58] Field of Search ..... 211/74, 75; D7/602

[56] References Cited

U.S. PATENT DOCUMENTS

| | | | |
|---|---|---|---|
| 2,012,983 | 9/1935 | Bales | 211/74 |
| 2,170,641 | 8/1939 | Lancelot | 211/74 |
| 2,580,676 | 1/1952 | Gross | 211/75 |
| 4,064,992 | 12/1977 | Ralston et al. | 211/75 |
| 4,973,018 | 11/1990 | Agor | 211/75 |

OTHER PUBLICATIONS

N.M. Sozon and A.C. Noble, Sensory Study of the Effect of Fluorescent Light on a Sparkling Wine and Its Base Wine Am. J. Enol, Vitic., vol. 40, No. 4, 1989.

*Primary Examiner*—Alvin Chin-Shue
*Assistant Examiner*—Sarah Purol
*Attorney, Agent, or Firm*—Lieberman & Nowak, LLP

[57] ABSTRACT

An illuminated bottle display rack comprises a structure having a hollow area defined by front, back, top, bottom, right and left walls. The dimensions of the hollow include a depth sufficient to accommodate all or part of the length of a bottle on display, and a light source mounted on the inside surface of the back wall. Fans are mounted through the top wall for exhausting warm air from, and/or for drawing cool in into, the hollow. UV filters are placed within said hollow between said light source and said plurality of bottles. Translucent casings are preferably mounted within said hollow and corresponding to a plurality of openings within the front wall of the display rack, each for receiving a bottle to be displayed.

7 Claims, 2 Drawing Sheets

ILLUMINATED BOTTLE DISPLAY RACK

FIELD OF THE INVENTION

This invention relates to an illuminated display rack which can be used for the display of bottles containing wine or other liquids.

BACKGROUND OF THE INVENTION

The illumination of bottles of liquid on display can add a desirable aesthetic quality to the display. For some liquids, however, the illumination can also have a secondary negative impact on the quality of the liquid. For example, when subjected to light over an extended period of time, wine can degrade as a result of the consequential ultraviolet ("UV") radiation and heat. Such degradation includes the settling of the fruit aspects of the wine and a undesirable odor emanating from the wine.

SUMMARY OF THE INVENTION

Accordingly, it is an objective of the present invention to provide an illuminated bottle display rack while avoiding levels of damaging ultraviolet radiation and heat. The bottle display rack comprises a plurality of receptacles, for a plurality of bottles, a light source for illuminating the bottles, means for reducing the heat generated by the light source and means for reducing the ultraviolet radiation from the light source.

In one preferred embodiment of the invention, the bottle display rack comprises a structure having a hollow area defined by front, back, top, bottom, right and left walls. The dimensions of the hollow include a depth sufficient to accommodate all or part of the length of a bottle on display, and a light source mounted on the inside surface of the back wall. Fans are mounted through the top wall for exhausting warm air from, and/or for drawing cool into, the hollow. Two layers of UV filters are placed within said hollow between said light source and said plurality of bottles.

DETAILED DESCRIPTION OF THE INVENTION

Figure 1:
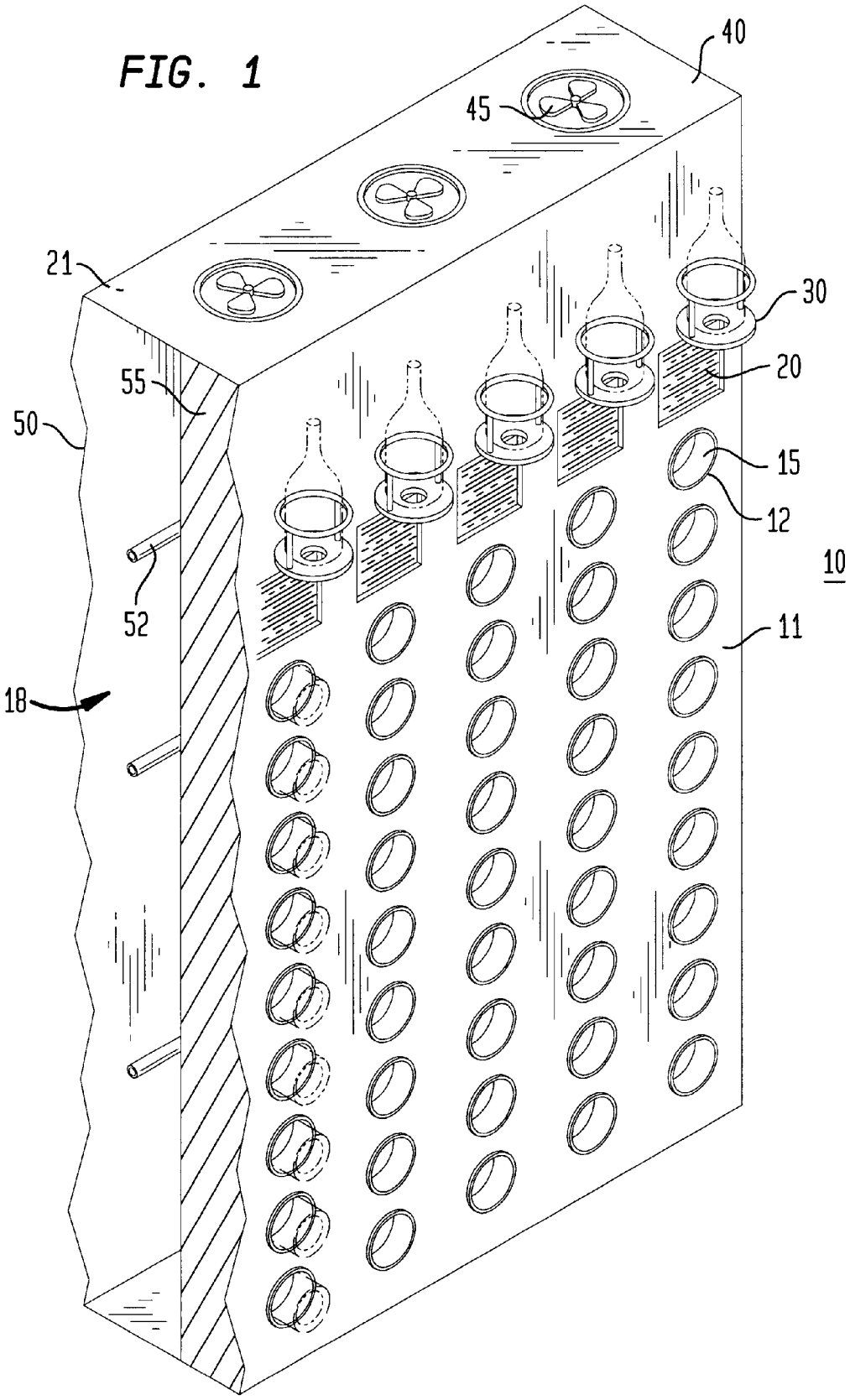
FIG. 1 depicts one embodiment of the illuminated bottle display rack of the present invention.

Referring to FIG. 1, an illuminated bottle display rack 10 is shown. The structure of display rack 10 generally comprises front wall 11, back wall 21, top wall 40 and right and left sides not shown. These walls define a hollow 18. It will be understood that the illuminated display rack of the present invention can be designed to be free standing or built into or against another a structure. Accordingly, it is not critical whether the walls defining hollow 18 are particular to the bottle display rack, or whether some or all exist as part of another structure such as the wall or ceiling of a room or building.

Figure 2:
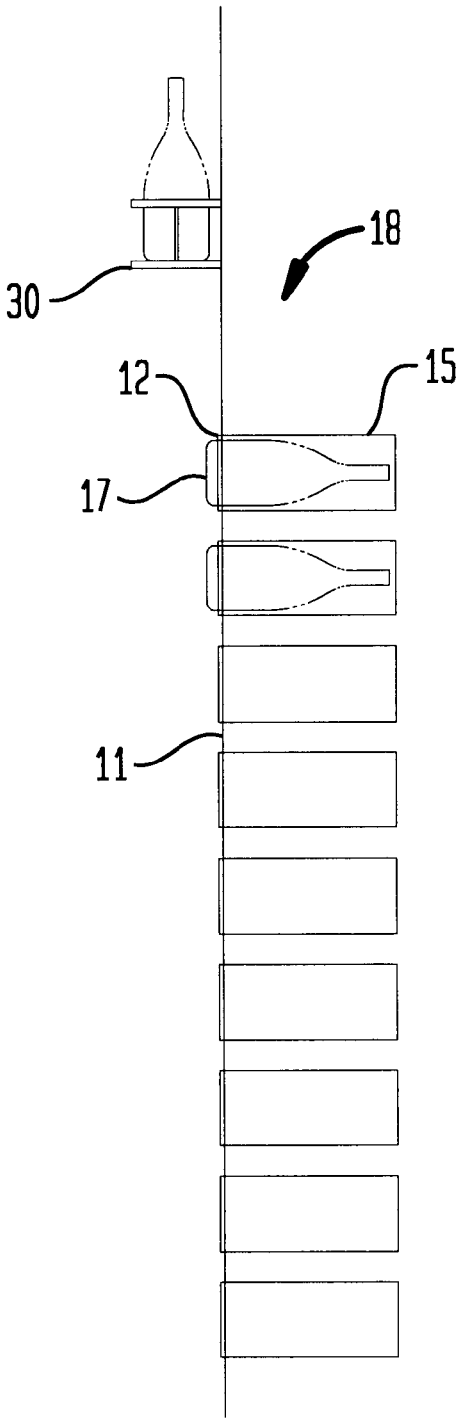
FIG. 2 is a side plan view of the front wall of an illuminated bottle display rack in accordance with the present invention.

Hollow 18 is designed such that its interior depth is sufficient to house the length of each bottle 17 to be displayed, in its entirety or part thereof, the source of illumination 52, and the means for removing heat 45 from within hollow 18. Each bottle 17 is received within bottle display rack 10 through openings 12 having an inner diameter larger than the outer diameter of bottles 17 to be received therein. Bottles 17 pass through openings 12 and rest within casings 15 attached to the inner surface of front wall 11 at each opening 12 and extending therefrom into hollow 18. Casings 15 function as pockets for each of bottles 17, as shown more clearly in the side plan view of FIG. 2, and are translucent so that the light from light source 52 will illuminate bottles 17 and the liquid therein.

It should be understood that the architectural design of the bottle display rack, and arrangement of bottles are not critical to the teachings of the present invention and many variations of the same are contemplated herein.

The light source shown in the embodiment of FIG. 1 comprises three fluorescent tubes 52, affixed to the inner surface 50 of back wall 21. The use of a fluorescent bulb is advantageous as compared to incandescent bulbs as less heat is generated. Nevertheless, incandescent bulbs may be a suitable alternative so long as the amount of heat within hollow 18 is managed through appropriate heat removal means.

Due to the heat generated by the light source used suitable means for removing some or all of the generated heat is requires. While the heat removal means of the present invention may be an innovative non-heat generating light source, or at least one that generates heat less than what will harm the liquid in bottles 17, frequently some additional means will be required. At times, passive means, such as ventilating orifices, not shown, will suffice. Other times, active means will be required. In the embodiment of FIG. 1, three exhaust fans 45 mounted in top wall 40 are shown. Other active means not shown may include coolants or refrigeration units. It will be apparent to one skilled in the art that a combination of any of the foregoing heat removal means may be employed.

Whatever heat removal means are employed, the critical concern is to maintain the interior of the display at approximately room temperature.

The final element of the present invention is to protect the liquid inside bottles 17 from UV radiation. The adverse effect of UV radiation on wine is known. See, for example, "Sensory Study of the Effect of Fluorescent Light on a Sparkling Wine and Its Base Wine", by Dozon and Noble, Am.J.Enol.Vitic., Vol. 40, No. 4, 1989. As shown in FIG. 1, a UV filter material 55 is placed between light source 52 and bottles 17. In one advantageous embodiment of the present invention, in addition to UV filter material 55, casings 15 are constructed of a material that blocks UV radiation. While plexiglass type of plastics provide some UV protection, the inventors have found that a material marketed as Lexan™, by General Electric Plastics, provides desirable levels of UV protection.

The foregoing merely illustrates the principles of the present invention. Those skilled in the art will be able to devise various modifications, which although not explicitly described or shown herein, embody the principles of the invention and are thus within its spirit and scope.

What is claimed is:

1. A bottle display rack, comprising:

a cabinet having a front, back, left side, right side and top walls, said walls defining a hollow section therebetween, said front wall having an outside face and an inner face and said back wall having at least an inner face;

a plurality of openings in said front wall, said openings extending therethrough from said front face to said inner face, each of said plurality of openings for receiving a bottle;

a translucent casing extending from each of said openings at said inner face of said front wall into said hollow section so as to receive a bottle extending through said opening;

a light source within said hollow section;

means for blocking ultraviolet radiation of said light source from said bottles; and means for reducing heat within said hollow section.

2. A bottle display rack according to claim 1 wherein said translucent casing comprises a material which includes the property of filtering out ultraviolet radiation.

3. A bottle display rack according to claim 1 wherein said light source includes at least one fluorescent light source.

4. A bottle display rack according to claim 1 wherein said light source is mounted to said inner face of said back wall.

5. A bottle display rack according to claim 1 wherein said means for reducing heat includes at least one ventilation orifice in one or more of said walls.

6. A bottle display rack according to claim 1 wherein said means for reducing heat includes at least one exhaust fan mounted within one of said walls of said bottle display rack.

7. A bottle display rack according to claim 2 wherein said material is an ultraviolet protecting plastic.

* * * * *